US011499418B2

(12) United States Patent
Granville et al.

(10) Patent No.: US 11,499,418 B2
(45) Date of Patent: Nov. 15, 2022

(54) FLOW CHARACTERIZATION TOOL

(71) Applicant: Halliburton Energy Services, Inc., Houston, TX (US)

(72) Inventors: John Philip Granville, Humble, TX (US); Terry Don Bickley, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 86 days.

(21) Appl. No.: 16/631,796

(22) PCT Filed: Dec. 10, 2018

(86) PCT No.: PCT/US2018/064671
§ 371 (c)(1),
(2) Date: Jan. 16, 2020

(87) PCT Pub. No.: WO2020/122856
PCT Pub. Date: Jun. 18, 2020

(65) Prior Publication Data
US 2021/0215035 A1 Jul. 15, 2021

(51) Int. Cl.
*E21B 47/10* (2012.01)

(52) U.S. Cl.
CPC ..... *E21B 47/10* (2013.01)

(58) Field of Classification Search
CPC ..... E21B 21/08; E21B 17/10
See application file for complete search history.

(56) References Cited

U.S. PATENT DOCUMENTS

| | | | | |
|---|---|---|---|---|
| 4,686,653 | A | 8/1987 | Staron et al. | |
| 5,092,423 | A * | 3/1992 | Petermann | E21B 17/1021 181/102 |
| 6,531,694 | B2 | 3/2003 | Tubel et al. | |
| 9,784,862 | B2 | 10/2017 | Childers et al. | |
| 2008/0307877 | A1* | 12/2008 | Cook | E21B 43/11 73/152.57 |
| 2010/0258304 | A1* | 10/2010 | Hegeman | E21B 49/08 166/250.01 |
| 2010/0326654 | A1* | 12/2010 | Hemblade | E21B 47/113 166/250.01 |
| 2012/0048541 | A1* | 3/2012 | Jacob | E21B 47/01 166/254.2 |
| 2015/0167402 | A1 | 6/2015 | Chang | |
| 2016/0032711 | A1 | 2/2016 | Sheiretov et al. | |

(Continued)

FOREIGN PATENT DOCUMENTS

WO 2020076286 A1 4/2020

OTHER PUBLICATIONS

PCT Application Serial No. PCT/US2018/064671, International Search Report, dated Aug. 21, 2019, 3 pages.

(Continued)

*Primary Examiner* — Sean D Andrish
(74) *Attorney, Agent, or Firm* — Delizio, Peacock, Lewin & Guerra

(57) ABSTRACT

An apparatus includes a central body having a longitudinal axis and a first extended member attached to the central body, wherein the first extended member extends away from the longitudinal axis. The apparatus also includes a first mechanically sensitive sensor mechanically coupled to the first extended member.

23 Claims, 8 Drawing Sheets

(56) References Cited

U.S. PATENT DOCUMENTS

| | | | | |
|---|---|---|---|---|
| 2017/0254183 | A1 | 9/2017 | Vasques et al. | |
| 2018/0003027 | A1* | 1/2018 | Donzier | E21B 17/1021 |
| 2019/0264556 | A1* | 8/2019 | Wilson | E21B 47/06 |
| 2019/0301258 | A1* | 10/2019 | Li | E21B 47/09 |
| 2020/0033494 | A1* | 1/2020 | Patterson | G01V 1/50 |
| 2020/0109612 | A1 | 4/2020 | Granville et al. | |

OTHER PUBLICATIONS

PCT Application Serial No. PCT/US2018/064671, International Written Opinion, dated Aug. 21, 2019, 6 pages.

* cited by examiner

FLOW CHARACTERIZATION TOOL

BACKGROUND

The disclosure generally relates to the field of subsurface characterization and more particularly to acoustic and ultrasonic signal processing.

During many well operations, solid and fluid flow can be separated from another section of a well by a barrier. Impacts from solid particles, corrosive compounds in a fluid, and powerful mechanical forces flowing through the well cause erosion and material failure in various subsurface components. Flow characterization can provide information regarding flow geometry, such as an azimuth or radius of flow, and determine regions having flow irregularities in an annulus indicative of erosion, material failure, blockage, or improper well completion.

Accurate flow characterization is made more challenging when one or more barriers exist between a volume having flow and sensors capable of measuring the flow. Such barriers can include porous barriers such as sand screens and solid barriers such as well tubing and casing. Increasing the accuracy of flow characterization across a barrier can provide benefits such as reducing the risk of equipment failures and optimizing well production, well stimulation, and perforating operations.

BRIEF DESCRIPTION OF THE DRAWINGS

Embodiments of the disclosure can be better understood by referencing the accompanying drawings.

DESCRIPTION OF EMBODIMENTS

Figure 1:
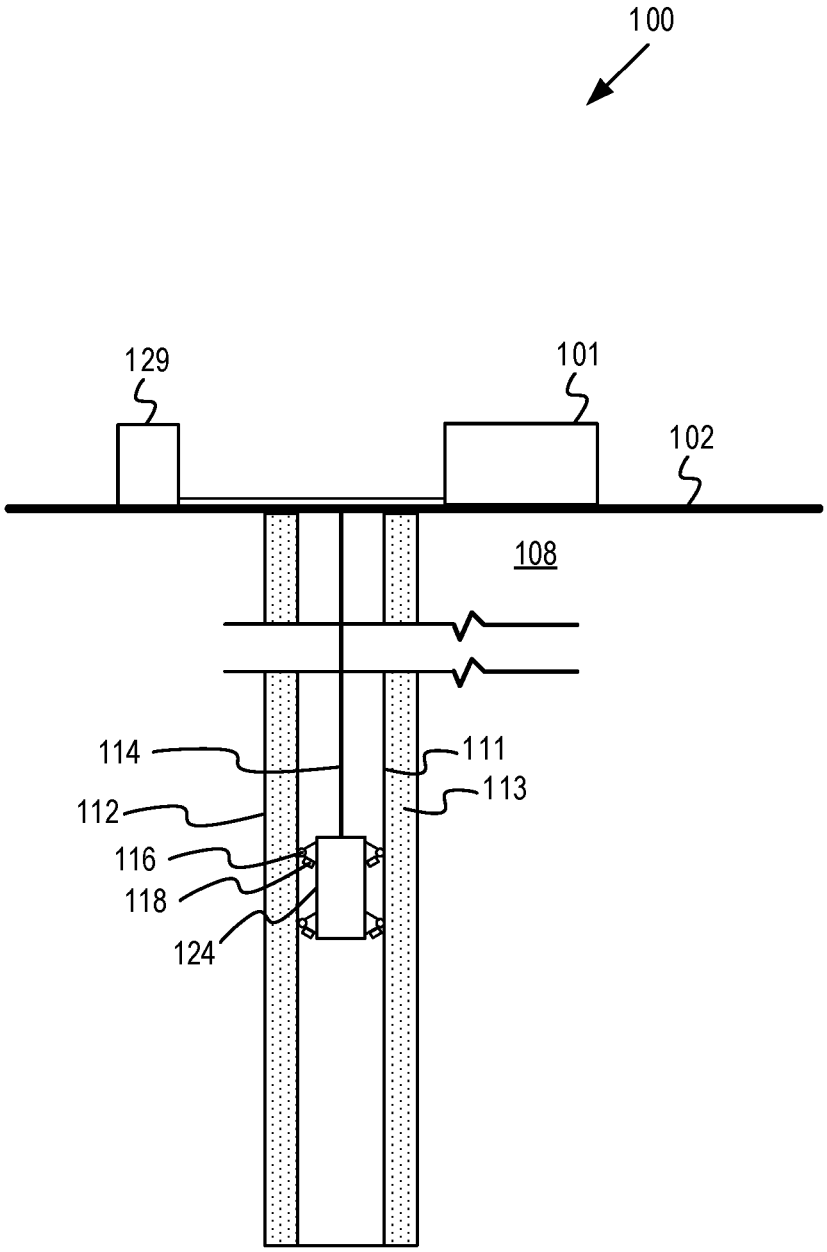
FIG. 1 is an elevation view of an onshore well system operating a wireline tool that includes a flow characterization tool.

The description that follows includes example systems, methods, techniques, and program flows that embody aspects of the disclosure. However, it is understood that this disclosure can be practiced without these specific details. For instance, this disclosure refers to a vibration sensor in illustrative examples. Aspects of this disclosure can be instead applied to other mechanically sensitive sensors such as accelerometers, geophones, pressure sensors or acoustic sensors. Furthermore, this disclosure refers to rolling elements ("rollers") in illustrative examples, but aspects of this disclosure can instead be applied to other friction-reducing elements such as lubricating elements, elements having a low-friction surface, and/or elements having sacrificial layers (e.g. graphite-coated bearings). In other instances, well-known instruction instances, protocols, structures and techniques have not been shown in detail in order not to obfuscate the description.

Various embodiments relate to a flow characterization tool used downhole in a borehole to measure impacts on a well structure during flow in the proximity of the well structure. The flow characterization tool can have a central body that includes an acoustic-reducing component having multiple apertures to mitigate vibrations along the central body. The central body can be attached to a set of one or more extended members, wherein an extended member is a physical structure that radially extends from the axis of the central body. The extended member can include a mechanically elastic material that can return to its original shape after a deformation. The extended member can include multiple rigid components (e.g. arms) connected by rotatable, bendable, or otherwise movable elements. In addition, the extended member can include one or more friction reducing elements at a distal end of the extended member from the central body axis that reduces the friction between the extended member and a barrier in a borehole. Examples of friction-reducing elements can include rolling elements ("roller") such as wheels and lubricating elements such as pressure-activated lubricant dispensers. A mechanically sensitive sensor is mechanically coupled to the extended member, wherein a mechanical coupling of two objects means the two objects are physically attached (e.g. via screws, bolts, adhesives, welding, tight fitting, etc.) and capable transferring force to each other. Thus, the mechanically sensitive sensor can acquire mechanical measurements of forces/motion transferred to the extended member. Such mechanical measurements can include any measurement of a metric corresponding with a mechanical wave (or reaction to a mechanical wave) such as force, acceleration, velocity, displacement, etc. The mechanically sensitive sensor can be a multi-dimensional sensor, allowing the sensor to measure multi-dimensional mechanical activity such as vibrations in a radial direction, tangential direction, and/or a longitudinal direction simultaneously.

The flow characterization tool can be lowered into a well containing at least one installed barrier between the center of the well and the formation wall. The installed barrier can include various materials and designs, such as an irregularly-shaped porous polymer mesh or a solid steel annulus. The installed barrier separates the flow of at least one of a fluid or solid on one side of the barrier from the flow characterization tool at the other side of the barrier, wherein the flow can include solid particles. Vibrating forces and other forms of mechanical forces applied onto the barrier by the impingement of solid particle flow, regular pressure waves, or one-time impacts can be transferred to an extended member of the flow characterization tool through a contact point between the extended member and the barrier. One or more mechanically sensitive sensors attached to the extended member can acquire a set of mechanical measurements of the mechanical forces transferred from the barrier onto the extended member. In addition, a set of mechanical measurements can be used to determine the amplitudes, frequencies and other properties of motion-induced noise, wherein disturbances caused by the friction of the tool to the barrier contact point can generate the motion-induced noise. In response to a motion-induced noise exceeding a noise threshold, the lowering of the flow characterization tool can be slowed or stopped in order to reduce the motion-induced noise.

The geometry of the extended member on a flow characterization tool increases the sensitivity of mechanical sensors to differences between the longitudinal components and radial components of forces applied on a barrier. This increased sensitivity results in increases of the diagnostic capabilities during flow characterization. In addition, measurements from sets of radially distributed extended members having mechanically coupled sensors along one or more axial positions increases the ability to characterize flow and detect irregularities across a barrier in three dimensions. Such measurements from the flow characterization tool can increase the accuracy and precision of diagnoses regarding erosion and material failure during flow characterization.

Example Tools

FIG. 1 is an elevation view of an onshore well system operating a wireline tool that includes a flow characterization tool. The onshore well system 100 includes a pumping system 101 installed on surface 102 next to a borehole 112. The flow characterization tool 124 can be lowered by the conveyance 114 inside of the barrier 111, which is inside of the borehole 112, wherein the conveyance 114 can include a slickline or coiled tubing. The barrier can be one or more various components, such as metal piping, polymer tubing, a sand screen, etc. In the annulus region 113, solid particles from the subsurface formation 108 can flow either into or out of the borehole 112, generating measurable impacts onto the barrier 111. Examples of solid particles that can flow and generate impacts include sand, sediments, polymeric solids, nanoparticle aggregates, metallic particles, etc.

Figure 5:
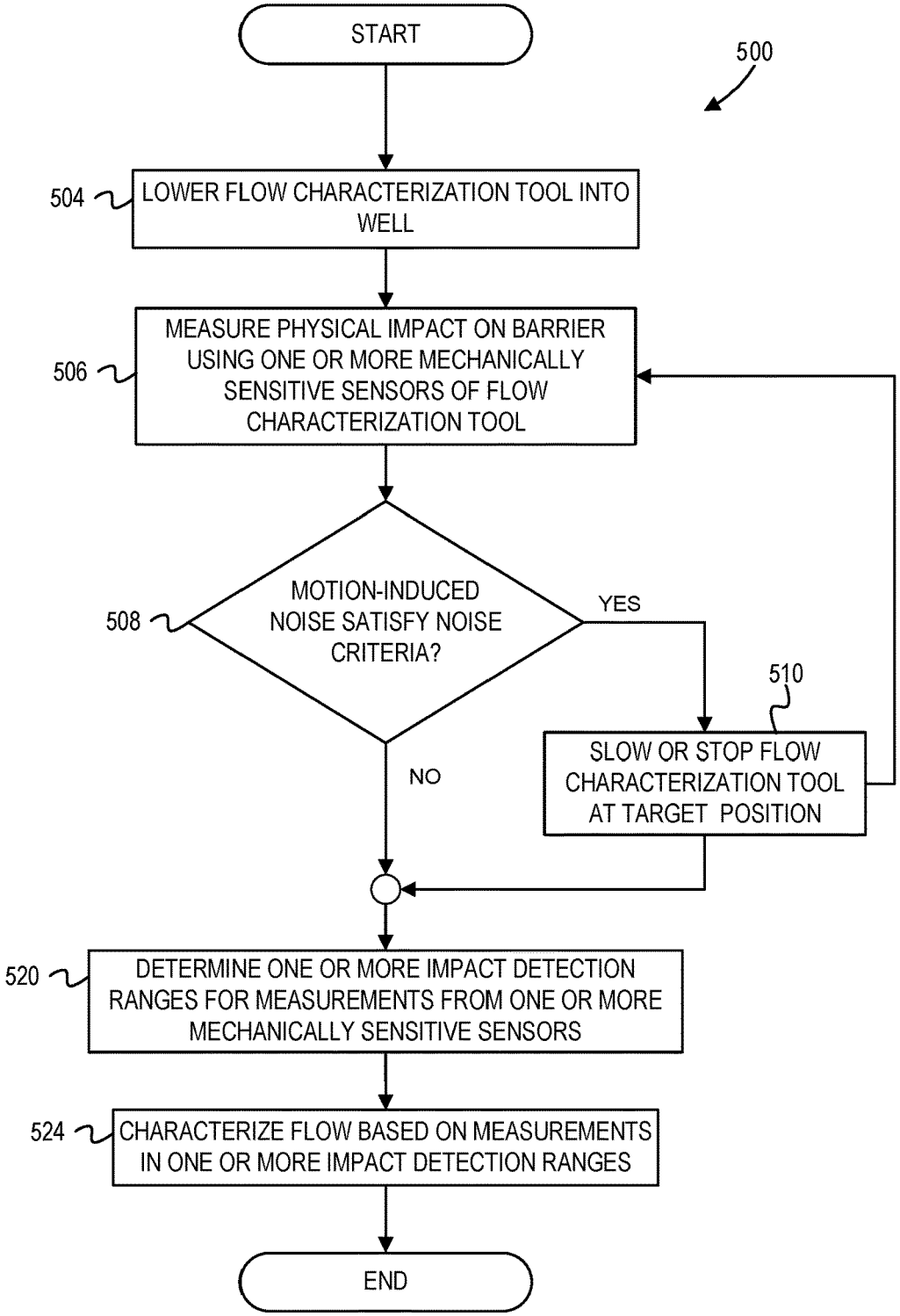
FIG. 5 is a flowchart of operations to characterize particle vibrations on a barrier caused by solid particle impacts using a flow characterization tool.

The flow characterization tool 124 is suspended in the borehole by a conveyance 114 that connects the flow characterization tool 124 to a surface system 129 that can include one or more processors and computer memory devices to perform at least one of the operations described below in the flowchart 500 of FIG. 5. In some embodiments, the flow characterization tool 124 can include a set of extended members including the extended member 116, which is in in contact with the barrier 111. A mechanically sensitive sensor 118 is mechanically coupled to the extended member 116 to measure vibrating forces and other forces applied onto the barrier 111 from the fluid and solid particles flowing through the annulus region 113. With reference to FIG. 5, the flow characterization tool 124 can also include one or more processors and computer memory devices to perform at least one of the operations described below in the flowchart 500.

In some embodiments, the flow characterization tool 124 can be active during an injection operation and can detect irregular flow indicative of erosion and/or material failure. For example, the flow characterization tool 124 can detect that solid particle flow in the annulus 113 has eroded a section of the barrier 111. In response, the surface system 129 can reduce a fluid injection rate or solid particle injection rate of the injection operation.

Figure 2:
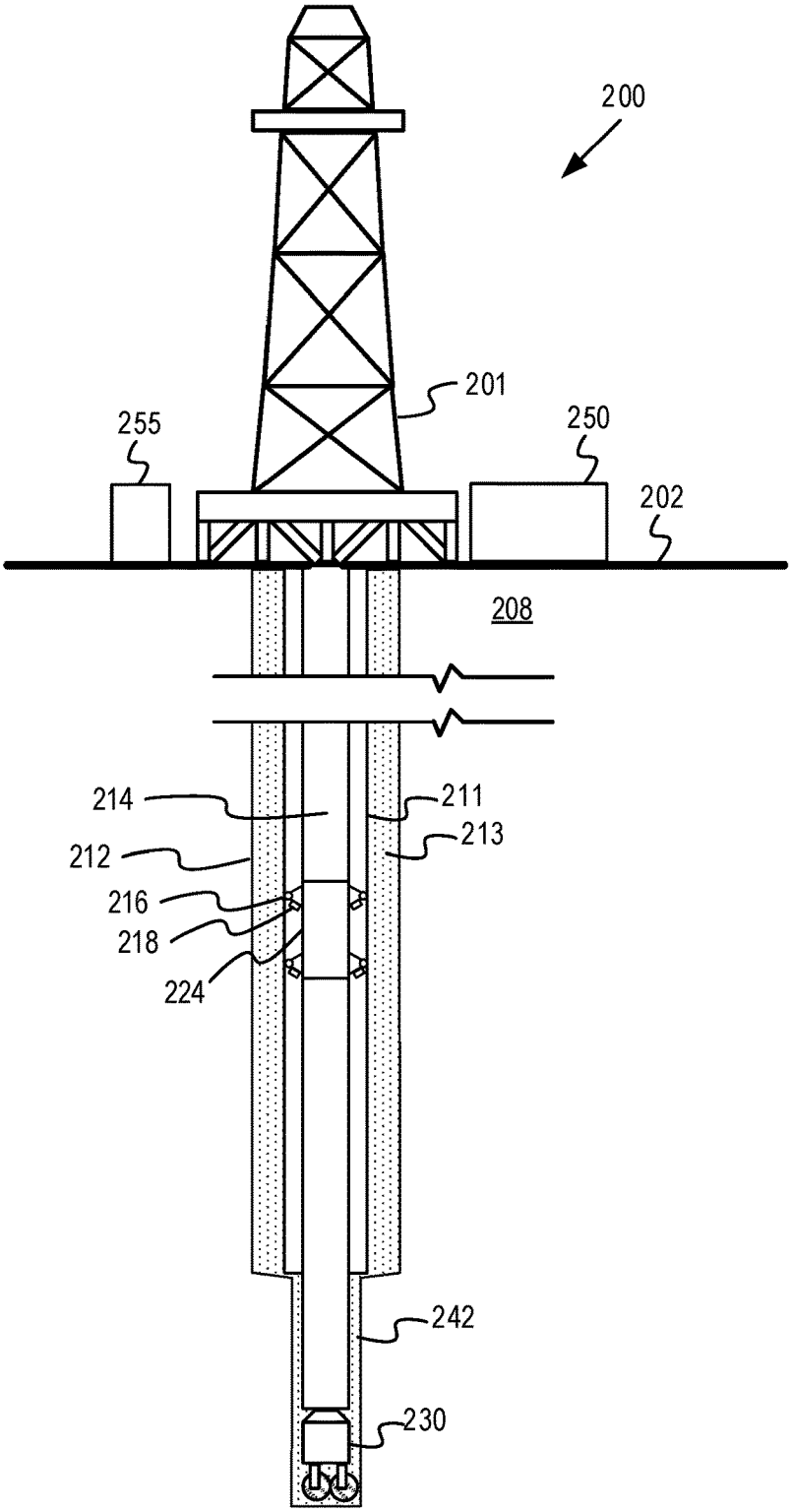
FIG. 2 is an elevation view of an onshore platform operating a downhole drilling assembly that includes a flow characterization tool.

FIG. 2 is an elevation view of an onshore platform operating a downhole drilling assembly that includes a flow characterization tool. In FIG. 2, a drilling system 200 includes a drilling rig 201 located at the surface 202 of a borehole 212. The drilling system 200 also includes a pump 250 that can be operated to pump fluid through a drill string 214. The drill string 214 can be operated for drilling the borehole 212 through the subsurface formation 208 using the drill bit 230. The drill bit 230 can be lowered through a cased section that includes the barrier 211 before being used for drilling the newly drilled region 242.

A flow characterization tool 224 attached to the drill string 214 can be lowered along with the drill bit 230. The flow characterization tool 224 is inside of the barrier 211, which is inside of the borehole 212. The barrier can include one or more components, such as metal piping, polymer tubing, a sand screen, etc. Solid particles flow out of the well through the annulus region 213 and can apply measurable impacts onto the barrier 211. In some embodiments, the flow characterization tool 224 can include an extended member 216 in contact with the barrier 211. A mechanically sensitive sensor 218 is mechanically coupled to the extended member 216 and can measure impacts, vibrations, and other force-related phenomena from the barrier 211.

The flow characterization tool 224 can transmit measurements to a surface system 255. The surface system 255 that can include one or more processors and computer memory devices to perform at least one of the operations described below in the flowchart 500 of FIG. 5. In some embodiments, the flow characterization tool 224 can acquire mechanical measurements from the barrier 211 as the drill bit 230 is active and/or being lowered. Alternatively, the flow characterization tool 224 can acquire mechanical measurements from the barrier 211 while the drill bit 230 is stationary in order to reduce drilling-related noise in the sensor measurements from the flow characterization tool 224. In addition, with reference to FIG. 5, the flow characterization tool 224 can also include one or more processors and computer memory devices to perform at least one of the operations described below in the flowchart 500.

In some embodiments, drilling operations can be altered or stopped in response to results of a flow characterization performed by the surface system 255. The mechanical measurements provided by the flow characterization tool 224 can increase the accuracy of the flow characterization performed by the surface system 255 and thus increase the performance of the drilling operation. For example, if a flow characterization based on mechanical measurements provided by the flow characterization tool 224 determines that a component of the barrier 211 is eroded and risks being perforated, the surface system 255 can transmit a set of instructions to stop the drilling operation.

Example Vibration Characterization Tools

Figure 3:
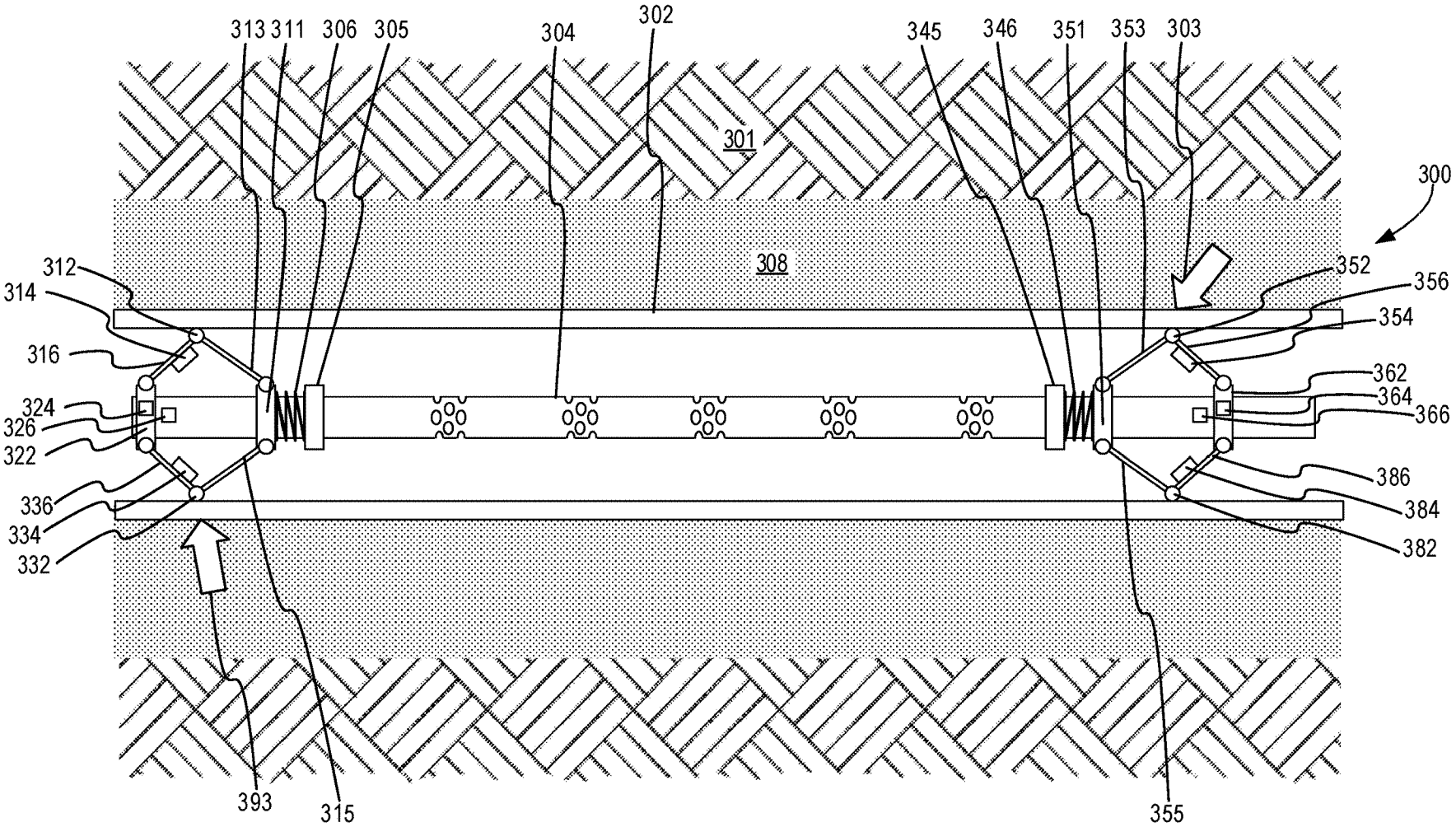
FIG. 3 is a partial cross-sectional view of a flow characterization tool having a two-arm extendable member and a vibration sensor mechanically coupled to the extendable member.

FIG. 3 is a partial cross-sectional view of a flow characterization tool having a two-arm extendable member and a vibration sensor mechanically coupled to the extendable member. The flow characterization tool 300 includes an acoustic array tool 304, which can characterize flow patterns within a barrier 302. An inner left fixed stabilizer 305 is concentric with and attached to the acoustic array tool 304. The acoustic array tool 304 includes one or more acoustic receiving elements, such as hydrophones or pressure sensors. A left spring 306 connects the inner left fixed stabilizer 305 to an inner left movable centralizer 311 at the left end of the acoustic array tool 304. The inner left movable centralizer 311 includes a roller attached to the proximal end of a first arm 313 that allows the first arm 313 to rotate. An outer left centralizer 322 is further to the left of the inner left movable centralizer 311 and includes a roller attached to a second arm 316 that allows the second arm 316 to rotate. In addition, the outer left centralizer 322 includes a left centralizer sensor 324. The first arm 313 and second arm 316 can be attached to each other by an upper left contact roller 312 attached to the distal ends of the first arm 313 and second arm 316. An upper left arm sensor 314 is mechanically coupled to the second arm 316. Similarly, the inner left movable centralizer 311 also includes a roller attached to a third arm 315 and the outer left centralizer 322 also includes a roller attached to a fourth arm 336, allowing each respective arm to rotate. The third arm 315 and fourth arm 336 can be attached to each other by a lower left contact roller 332 attached to the distal ends of the third arm 315 and fourth arm 336, wherein a lower left arm sensor 334 is mechanically coupled to the fourth arm 336. A left spring 306 exerts a leftward force onto the inner left movable centralizer 311, which then pushes the upper left contact roller 312 and lower left contact roller 332 radially away from the axis of the acoustic array tool 304 into contact with the barrier 302. In addition to the upper left arm sensor 314 and the left centralizer sensor 324, a sensor 326 is in the proximity of the left centralizer sensor 324 and attached to the acoustic array tool 304. In some embodiments, the direct mechanical coupling between the acoustic array tool 304 and the sensor 326 allows the sensor 326 to be used to acquire a reference measurement, wherein the reference measurement can be used for decoupling particle impacts from other acoustic effects in the wellbore.

Similarly, an inner right fixed stabilizer 345 is concentric with and attached to the acoustic array tool 304. A right spring 346 connects the inner right fixed stabilizer 345 to an inner right movable centralizer 351 at the right end of the acoustic array tool 304. The inner right movable centralizer 351 includes a roller attached to a fifth arm 353. An outer right centralizer 362 is further to the right of the inner right movable centralizer 351 and includes a roller attached to a sixth arm 356. In addition, the outer right centralizer 362 includes a right centralizer sensor 364. The fifth arm 353 and sixth arm 356 can be attached to each other by an upper right contact roller 352 attached the distal ends of the fifth arm 353 and sixth arm 356. An upper right arm sensor 354 is mechanically coupled to the sixth arm 356. Similarly, the inner right movable centralizer 351 also includes a roller attached to a seventh arm 355 and the outer right centralizer 362 also includes a roller attached to an eighth arm 386. The seventh arm 355 and eighth arm 386 can be attached to each other by a lower right contact roller 382 attached the distal ends of the seventh arm 355, wherein a lower right arm sensor 384 is mechanically coupled to the eighth arm 386. A right spring 346 exerts a rightward force onto the inner right movable centralizer 351, which then pushes the upper right contact roller 352 and lower right contact roller 382 radially outwards into contact with the barrier 302. In addition to the upper right arm sensor 354 and the right centralizer sensor 364, a sensor 366 is in the proximity of the right centralizer sensor 364 and is attached to the acoustic array tool 304. Similar to the sensor 326, the direct mechanical coupling between the acoustic array tool 304 and the sensor 366 allows the sensor to be used to provide a reference measurement, wherein the reference measurement can be used for decoupling particle impacts from other acoustic effects in the wellbore.

In some embodiments, the springs can be replaced by other elastic elements such as a polymer material, wherein the elastic elements have an elasticity substantially parallel (within 90%) to the longitudinal axis of the acoustic array tool 304. Likewise, the rollers can be replaced by other friction-reducing element, such as a lubricated material or ultra-smooth material.

In some embodiments, the flow characterization tool 300 is positioned inside of the barrier 302, which is itself inside of a borehole drilled into the formation 301. Solid particles and fluids can flow inside of the annulus 308 and impacts/pressure waves from the solid particles and fluids can hit the barrier 302. The arrow 303 represents one such direction of an impact and the arrow 393 represents a second direction of a different impact. In some embodiments, constant impingement from solid particle flow can generate vibrations in the barrier 302. These vibrations in the barrier 302 can be transferred to the first extended member formed by the first arm 313 and the second arm 316, the second extended member formed by the third arm 315 and the fourth arm 336, the third extended member formed by the fifth arm 353 and the sixth arm 356, and the fourth extended member formed by the seventh arm 355 and the eighth arm 386. The physical contact via the contact rollers between the barrier 302 and the extended members increases the sensitivity and accuracy of the mechanically sensitive sensors when measuring force and motion applied on the extended members from the barrier 302.

The use of multiple extended members at different axial positions (e.g. at the position of the first extended member and the second extended member) along the acoustic array tool 304 provides physical stability and centralization of the flow characterization tool 300, which can increase the accuracy and precision of measurements made by the sensors attached to the extended members. In some embodiments, stabilization/centralization can be provided using other components attached to the acoustic array tool 304, and the flow characterization tool 300 can have a set of extended members with attached sensors at one axial position of the acoustic array tool 304. Furthermore, while the flow characterization tool 300 depicts sets of extended members at two different axial positions, other flow characterization tools can include all of their extended members at a single axial position or more than two different axial positions. In addition, while the flow characterization tool 300 depicts two extended members per set of extended members that are radially distributed at a shared axial position along the acoustic array tool 304, a set of extended members can also have one extended member, three extended members, or any other number of extended members in the set of extended members. In some embodiments, radially distributed multiple measurements at multiple axial points can also increase the resolution of flow characterization in three dimensions. In alternative embodiments, each of the sensors can be on different arms or a different component of the flow characterization tool 300. For example, the upper left arm sensor 314 can be attached to the third arm 315 instead of the first arm 313.

Figure 4:
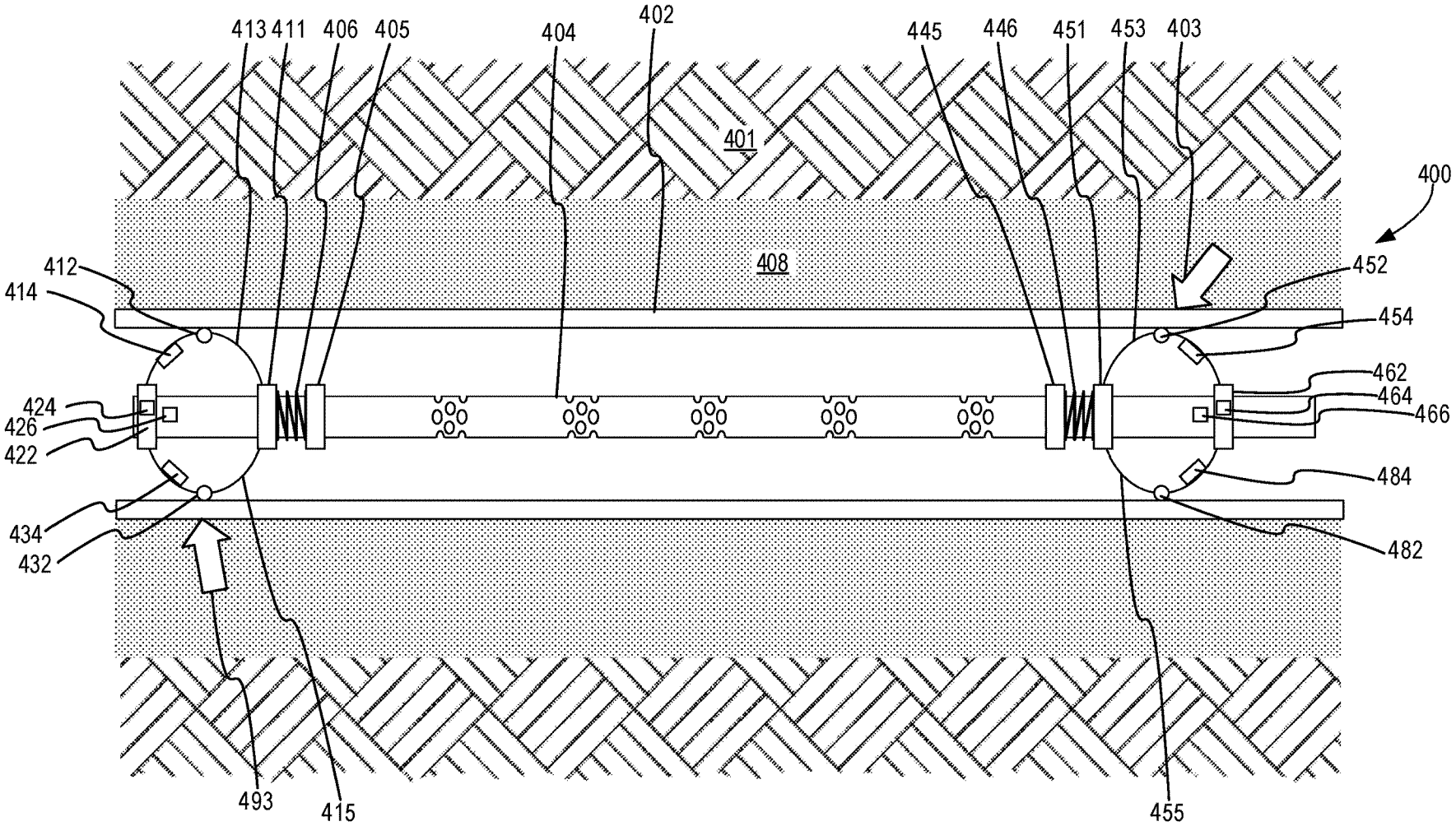
FIG. 4 is a partial cross-sectional view of a flow characterization tool having a bent extendable member and a vibration sensor mechanically coupled to the extendable member.

FIG. 4 is a partial cross-sectional view of a flow characterization tool having a bent extendable member and a vibration sensor mechanically coupled to the extendable member. Each of the bent arms described below are extendable members and include a bendable, elastic component that allows the bent arms to reversibly extend radially away from the axis of a flow characterization tool 400. The flow characterization tool 400 includes the acoustic array tool An inner left fixed stabilizer 405 is concentric with and attached to the acoustic array tool 404. A left spring 406 connects the inner left fixed stabilizer 405 to an inner left movable centralizer 411 at the left end of the acoustic array tool 404. An outer left centralizer 422 is further to the left of the inner left movable centralizer 411 and includes a left centralizer sensor 424. A first bent arm 413 is radially bent away from the axis of the acoustic array tool 404 and is attached to the inner left movable centralizer 411 at one end and the outer left centralizer 422 at the other end. The first bent arm 413 includes a first contact roller 412 at the distal point away from the axis of the acoustic array tool 404. A first arm sensor 414 is attached to the first bent arm 413. Similarly, the inner left movable centralizer 411 is attached to a second bent arm 415, which is also connected to the outer left centralizer 422. The second bent arm 415 includes a second contact roller 432 that is at a distal point away from the axis of the acoustic array tool 404, wherein a second arm sensor 434 is attached to the second bent arm 415. The left spring 406 exerts a leftward force onto the inner left movable centralizer 411, which then pushes the first contact roller 412 and second contact roller 432 radially outwards into contact with the barrier 402, allowing mechanical force to transfer from the barrier 402 onto the bent arms 413 and 415. Furthermore, a sensor 426 is attached to the acoustic array tool 404 and is in the proximity of the left centralizer sensor 424.

Similarly, an inner right fixed stabilizer 445 is concentric with and attached to the acoustic array tool 404. A right spring 446 connects the inner right fixed stabilizer 445 to an inner right movable centralizer 451 at the right end of the acoustic array tool 404. An outer right centralizer 462 is further to the right of the inner right movable centralizer 451 and includes a right centralizer sensor 464. A third bent arm 453 is radially bent away from the axis of the acoustic array tool 404 and is attached to the inner right movable centralizer 451 at one end and the outer right centralizer 462 at the other end. The third bent arm 453 includes a third contact roller 452 at a distal point away from the axis of the acoustic array tool 404. A third arm sensor 454 is attached to the third bent arm 453. Similarly, the inner right movable centralizer 451 is attached to a fourth bent arm 455, which is also connected to the outer right centralizer 462. The fourth bent arm 455 includes a fourth contact roller 482 at a distal point away from the axis of the acoustic array tool 404, wherein a fourth arm sensor 484 is attached to the fourth bent arm 455. The right spring 446 exerts a rightward force onto the inner right movable centralizer 451, which then pushes the third contact roller 452 and fourth contact roller 482 radially outwards into contact with the barrier 402, allowing mechanical force to transfer from the barrier 402 onto the bent arms 453 and 455. Furthermore, a sensor 466 is attached to the acoustic array tool 404 and is in the proximity of the right centralizer sensor 464.

In some embodiments, the flow characterization tool 400 is positioned inside of the barrier 402, which is itself inside of a borehole drilled into the formation 401. Fluids and solid particles can flow inside of the annulus 408 and impacts/pressure waves from the fluids and solid particles can hit the barrier 402. The arrow 403 represents one such direction of an impact/pressure wave and the arrow 493 represents a second direction of a different impact/pressure wave. In some embodiments, constant impingement from solid particle flow can generate vibrations in the barrier 402. These vibrations in the barrier 402 can be transferred to the first bent arm 413, the second bent arm 415, the third bent arm 453 and the fourth bent arm 455. The physical contact via the contact rollers between the barrier 402 and the extended members increases the sensitivity and accuracy of the sensors attached to the extended members.

Each of the sensors discussed above in FIG. 3 and FIG. 4 can be multi-dimensional mechanically sensitive sensors. For example, with reference to FIG. 4, each of the first arm sensor 414, second arm sensor 434, third arm sensor 454, and fourth arm sensor 484 can be a sensor measuring acceleration, velocity, or displacement. Other mechanically sensitive sensors can be used instead, such as an acoustic sensor or deformation sensor.

Example Flowchart

FIG. 5 is a flowchart of operations to characterize particle vibrations on a barrier caused by solid particle impacts using a flow characterization tool. FIG. 5 is a flowchart 500 that includes operations that are described in reference to the flow characterization tools of FIGS. 3-4. Operations of the flowchart 500 start at block 504.

At block 504, a flow characterization tool is lowered into the well. The flow characterization tool can be lowered while attached to a wireline, a drill pipe, etc. For example, during a wireline operation, the flow characterization tool can be part of a wireline tool and lowered during a stimulation operation (e.g. fluid injection into a well) that uses the wireline tool to monitor stimulation operations.

At block 506, the system measures physical impact on a barrier using one or more mechanically sensitive sensors of the flow characterization tool. During various well operations or natural phenomena, fluids and solid particles flowing near the barrier can impact the barrier. For example, with reference to FIG. 3, sand in the annulus 308 can flow and impact the barrier 302. Repeated impacts from continuous solid particle flow such as sand flow can generate characteristic vibrations in force and motion on the barrier. Single-event or stochastic impacts can generate amplitude and reflecting wave measurements indicative of the size/shape of a particle or fluid hitting the barrier. The force of these impacts can then be transferred from the barrier to an extended member of the flow characterization tool at a contact point between the barrier and the extended member, which can then be measured by the one or more mechanically sensitive sensors of the flow characterization tool. For continuous and repeating impacts that generate vibrations in the barrier, the measurements of the vibrational mechanical waves can include frequency and amplitude measurements over domains such as signal frequency, acceleration intensities, velocities, displacements, etc. For a single-event or stochastic impacts onto the barrier, the measurement of the mechanical waves generated by these impacts can be characterized by the amplitude of an initial impact and subsequent reflection wave amplitudes and frequencies.

In some embodiments, the mechanically sensitive sensors can obtain multiple sets of measurements simultaneously, wherein a first set of measurements are orthogonal to a second set of measurements. In addition, the mechanically sensitive sensors can acquire a control measurement, wherein the control measurement is acquired while solid particle flow is not in contact with the barrier. For example, the mechanically sensitive sensors can acquire a control measurement while only fluids are flowing around the barrier.

At block 508, a determination is made of whether motion-induced noise satisfies one or more noise criteria. The friction from the motion of the flow characterization tool can generate motion-induced noise in the measurements made by the one or more mechanically sensitive sensors of the flow characterization tool. In some embodiments, the motion-induced noise can satisfy the noise criteria when the motion-induced noise is below a frequency threshold and/or amplitude threshold and exceed the noise criteria otherwise, wherein the frequency threshold and amplitude threshold can correspond with each other. For example, a frequency threshold can be 20 kilohertz (kHz) for a corresponding amplitude threshold of −100 decibels, which generates the noise criterion that that the motion-induced noise is less than −100 decibels for all motion-induced noise having a frequency greater than 20 kHz. The system can compare the motion-induced noise to multiple noise criteria to determine whether the motion-induced noise criteria are satisfied. If the system determines that the motion-induced noise does not satisfy the one or more noise criteria, the operations of the flowchart 500 can proceed to block 510. Otherwise, operations of the flowchart 500 can proceed to block 520.

At block 510, the system slows or stops the flow characterization tool at a target position. In some embodiments, slowing or stopping the flow characterization tool at the target position can increase measurement quality at or near the target position. In some embodiments, the target position can be determined to have been reached when a measured depth reaches a target value. For example, a determination can be made that the flow characterization tool has reached a target position when the measured depth of the flow characterization tool is 5000 meters. The target position can be repeated over any arbitrary constant or variable interval. For example, a target position can be reached whenever a measured depth is a multiple of 5 meters as the measured depth increases from 50 meters to 20000 meters. Alternatively, a determination can be made that a target position is reached when one or more triggering criteria based on other measurements are met. For example, a target position can be reached when a neutron-generating tool attached to the flow characterization tool determines that the flow characterization tool is in a hydrocarbon-rich layer based on a measured neutron signal being within an expected range. When the tool is at the target position, the system can stop the flow characterization tool or slow the flow characterization tool to a speed wherein the motion-induced noise can satisfy the one or more noise criteria. For example, the noise criteria can include the criterion that the average frequency of the motion-induced noise is less than 1 kHz. In response, the flow characterization tool to can be slowed to a speed wherein the motion-induced noise is less than 1 kHz. Other criteria can include a criterion that the average frequency of the motion-induced noise measured by the flow characterization tool is less than 10 kHz.

At block 520, the system determines one or more impact detection ranges for measurements from the one or more mechanically sensitive sensors. In some embodiments, a lower bound of the impact detection range can be based on the noise criteria disclosed above at block 508. For example, the impact detection range can be based on a frequency range and the frequency threshold of 20 decibels can be used as a lower bound of the impact detection range. Alternatively, a bound of the impact detection range can be based on the motion-induced noise itself. For example, the lower bound of the impact detection range can be the frequency below which over 90% (or some other value such as 95% or 99%) of the amplitude-weighted motion-induced noise has been detected. In addition, a bound of the impact detection range can be based on a target impact type. For example, a target impact type can be sand flow impacts and a pre-set minimum sand flow frequency can be 25 kHz. Based on this target impact type, a lower bound of the impact detection range can be 25 kHz.

In some embodiments, a bound of the impact detection range can be based on one or more measurement ranges of the sensors attached to the flow characterization tool. For example, if an accelerometer has a 95% confidence frequency measurement range of 0 Hertz to 55 kHz and a 95% confidence amplitude measurement range of −130 decibels to −50 decibels, the upper bound of an impact detection range for frequency and amplitude corresponding to measurements from the accelerometer can be 55 kHz and −50 decibels, respectively.

At block 524, the system characterizes flow based on the measurements in the one or more impact detection ranges. In some embodiments, the system can characterize flow near the barrier by comparing mechanical measurements to mechanical measurements made at other time intervals and/or stored mechanical measurements from a database. For example, by comparing the mechanical measurements acquired during sand injection to mechanical measurements acquired before any sand injection or the introduction of other sources of solid particle flow (e.g. control measurements), the system can determine that sand is flowing in an annulus. As another example, by comparing the number of peaks and corresponding amplitudes of the measurements to stored measurements of damaged and undamaged wells, the system can determine that a profile of the sensor measurements is similar to that of damaged wells at a particular measured depth. In response, the system can characterize the flow as abnormal and/or indicate a risk of damage in the well at that particular measured depth.

The flowchart 500 is provided to aid in understanding the illustrations and is not to be used to limit scope of the claims. The flowchart includes example operations that can vary within the scope of the claims. Additional operations may be performed; fewer operations may be performed; the operations may be performed in parallel; and the operations may be performed in a different order. For example, the flow characterization tool does not have to slow down or stop as described for block 510. The process can be run in entirely in real-time, entirely in post-processing (i.e., after the tool is removed from the well), or a combination of real-time and post-processing. It will be understood that each block of the flowchart illustrations and/or block diagrams, and combinations of blocks in the flowchart illustrations and/or block diagrams, can be implemented by program code.

Example Data

Figure 6:
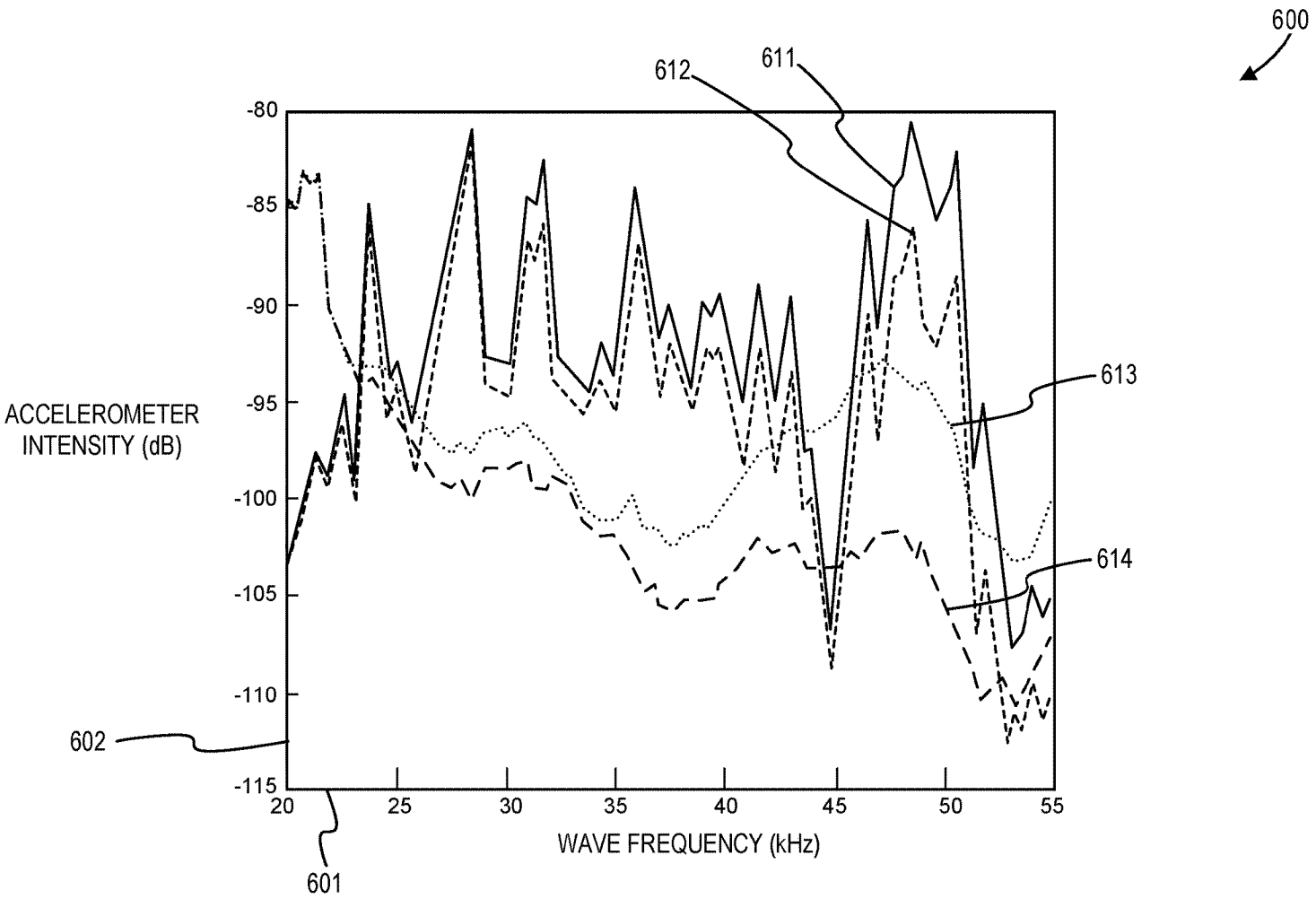
FIG. 6 is a plot comparing radial direction measurements from vibration sensors attached and not attached to an extended member of the flow characterization tool.

FIG. 6 is a plot comparing radial direction measurements from vibration sensors attached and not attached to an extended member of the flow characterization tool. The plot 600 has a horizontal axis 601 representing wave frequency in kilohertz (kHz) and a vertical axis 602 representing measured accelerometer intensity in the radial direction in decibel units. The plot 600 includes a first curve 611, second curve 612, third curve 613, and fourth curve 614. The first curve 611 represents the values corresponding to mechanical measurements of sand-water flow through a barrier using mechanically sensitive sensors mechanically coupled to an extended member. The second curve 612 represents the values corresponding to mechanical measurements of pure water flow through a barrier using mechanically sensitive sensors mechanically coupled to an extended member. The third curve 613 represents the values corresponding to mechanical measurements of sand-water flow through a barrier using mechanically sensitive sensors not mechanically coupled to an extended member. The fourth curve 614 represents the values corresponding to mechanical measurements of pure water flow through a barrier using mechanically sensitive sensors not mechanically coupled an extended member.

As shown when comparing the first curve 611 and the third curve 613, the mechanical measurements from the sensor mechanically coupled to the extended member is noticeably distinct from the mechanical measurements from the mechanically sensitive sensor not mechanically coupled to the extended member. Furthermore, for the majority of measured frequencies in the range between 20 kHz and 55 kHz, the mechanical measurements from the sensor mechanically coupled to the extended member have greater intensities than the mechanical measurements from the mechanically sensitive sensor not mechanically coupled to the extended member. Thus, mechanically sensitive sensors that are mechanically coupled to an extended member of a flow characterization tool can be more sensitive than mechanically sensitive sensors that are not mechanically coupled to an extended characterization tool.

In addition, as shown by a comparison of the first curve 611 and the second curve 612, measurements of sand and water flow are measurably distinct from measurements of pure water flow. Thus, measurements of a sensor mechanically coupled to an extended member can be used to determine the presence of solid particles in flow through a barrier. In some embodiments, a comparison of intensity amplitudes, magnitude of intensity change over frequency, and other plot metrics can be used to further characterize flow to discern flow properties such as a solid particle flow rate, whether the flow is laminar or turbulent, whether the solid particle flow is exhibiting flow patterns indicative of erosion or damage, etc.

Figure 7:
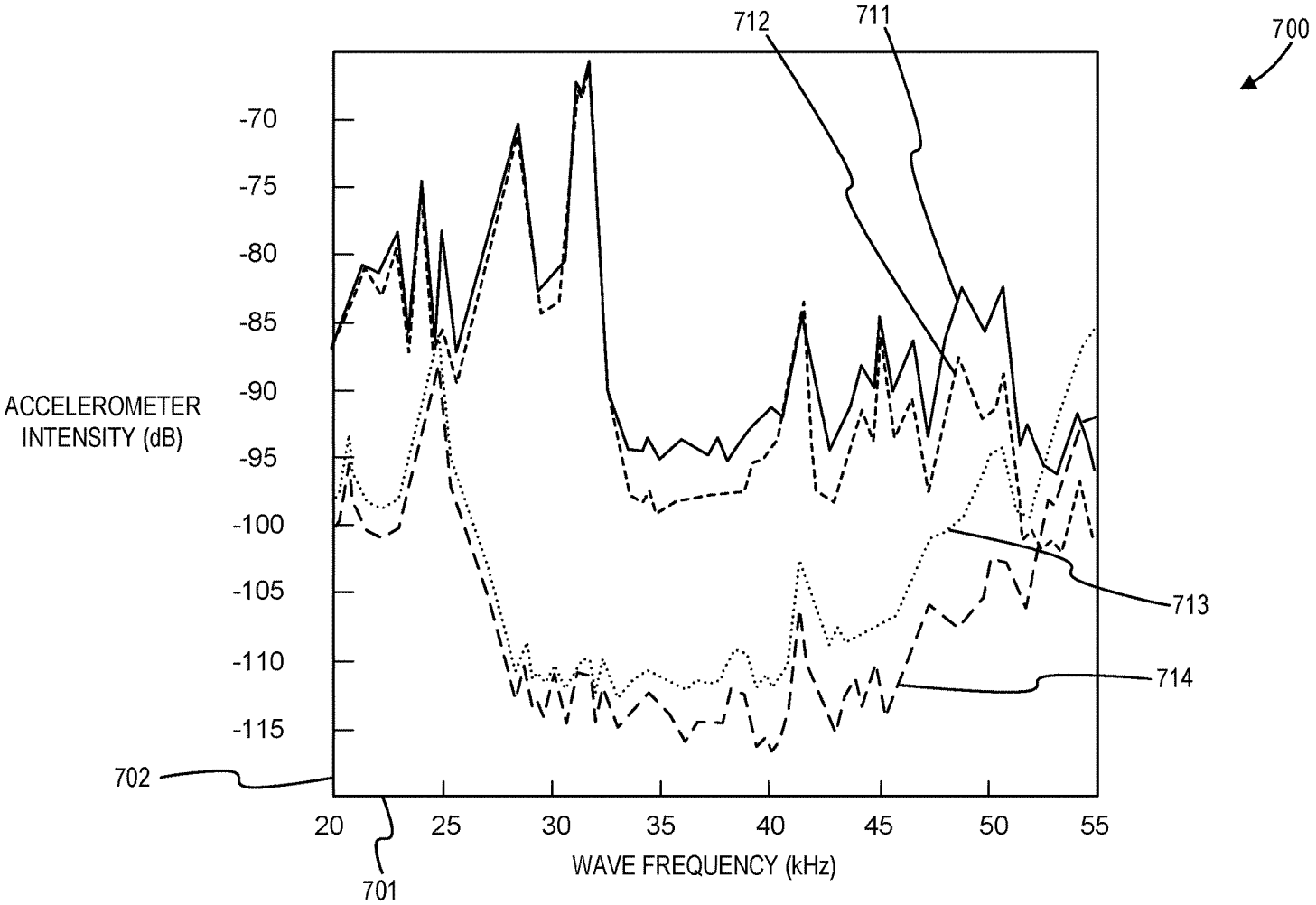
FIG. 7 is a plot comparing longitudinal direction measurements from vibration sensors attached and not attached to an extended member of the flow characterization tool.

FIG. 7 is a plot comparing longitudinal direction measurements from vibration sensors attached and not attached to an extended member of the flow characterization tool. The plot 700 has a horizontal axis 701 representing wave frequency in kHz and a vertical axis 702 representing measured accelerometer intensity in the longitudinal direction in decibel units. The plot 700 includes a first curve 711, second curve 712, third curve 713, and fourth curve 714. The first curve 711 represents the values corresponding to mechanical measurements of sand-water flow through a barrier using mechanically sensitive sensors mechanically coupled to an extended member. The second curve 712 represents the values corresponding to mechanical measurements of pure water flow through a barrier using mechanically sensitive sensors mechanically coupled to an extended member. The third curve 713 represents the values corresponding to mechanical measurements of sand-water flow through a barrier using mechanically sensitive sensors not mechanically coupled to an extended member. The fourth curve 714 represents the values corresponding to mechanical measurements of pure water flow through a barrier using mechanically sensitive sensors not mechanically coupled to an extended member. With reference to FIG. 6, the intensity range of mechanical measurements in the longitudinal direction shown in plot 700 can be greater than the intensity range of mechanical measurements in the radial direction shown in plot 600.

As shown when comparing the first curve 711 and the third curve 713, the mechanical measurements from the mechanically sensitive sensor that is mechanically coupled to the extended member is noticeably distinct from the mechanical measurements from the mechanically sensitive sensor not mechanically coupled to the extended member. Furthermore, for the majority of measured frequencies in the range between 20 kHz and 55 kHz, the mechanical measurements from the mechanically sensitive sensor that is mechanically coupled to the extended member have greater intensities than the mechanical measurements from the mechanically sensitive sensor not mechanically coupled to the extended member. Thus, mechanically sensitive sensors mechanically coupled to an extended of a flow characterization tool can be more sensitive than mechanically sensitive sensors not mechanically coupled to extended characterization tool.

In addition, as shown by a comparison of the first curve 711 and the second curve 712, mechanical measurements of sand and water flow are measurably distinct from mechanical measurements of pure water flow over a sufficient frequency range. Thus, mechanical measurements of a mechanically sensitive sensor that is mechanically coupled to an extended member can be used to determine the presence of solid particles in flow through a barrier. In some embodiments, a comparison of intensity amplitudes, magnitude of intensity change over frequency, and other plot metrics can be used to further characterize flow to discern flow properties as a solid particle flow rate, whether the flow is laminar or turbulent, whether the solid particle flow is proceeding through a damaged section, etc. With further reference to FIG. 6, the plot 600 and plot 700 can be provided by a same mechanically sensitive sensor. By basing any flow characterization on two directions instead of one, a system can increase the accuracy of a flow characterization operation.

Example Computer

Figure 8:
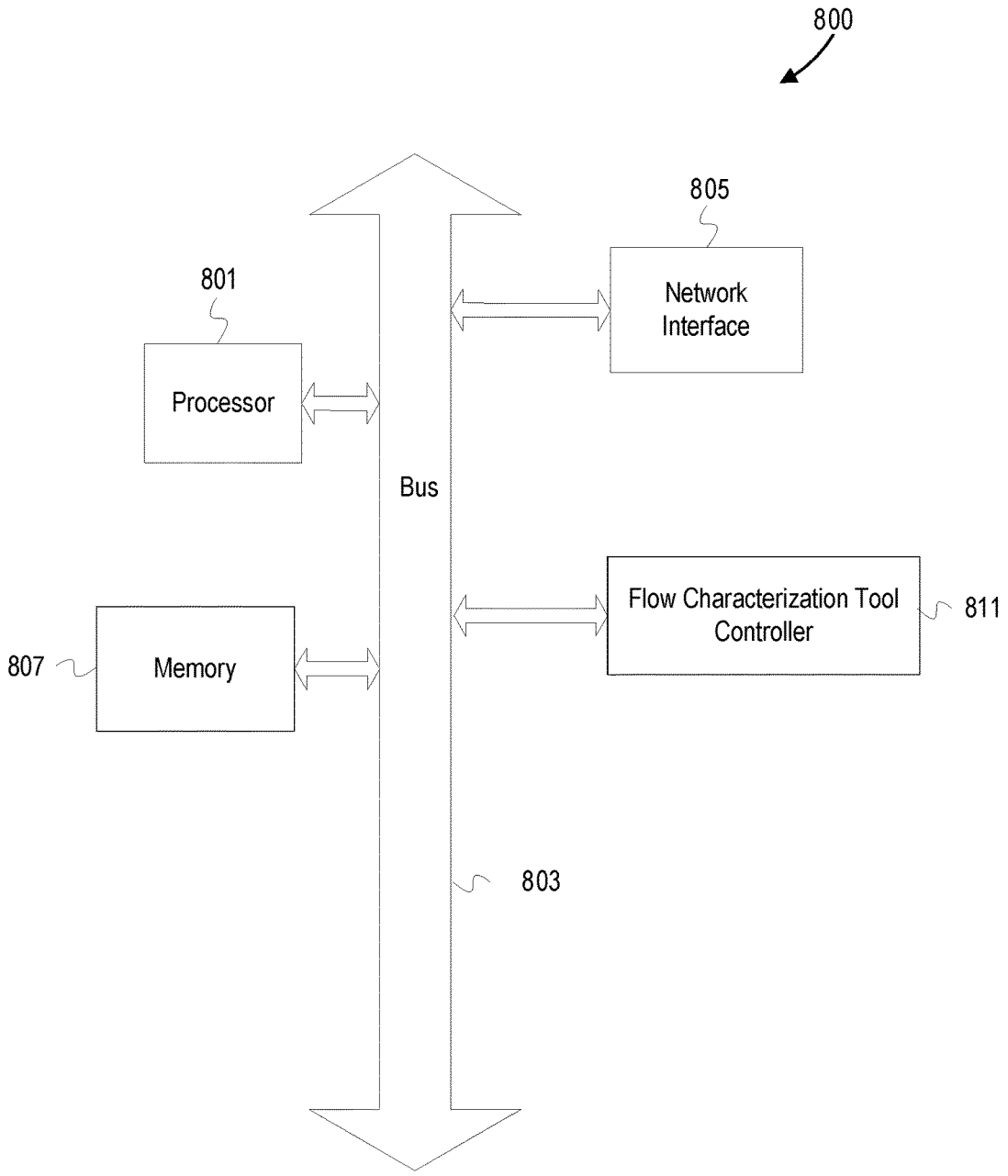
FIG. 8 is schematic diagram of an example computer device.

FIG. 8 is schematic diagram of an example computer device. A computer device 800 includes a processor 801 (possibly including multiple processors, multiple cores, multiple nodes, and/or implementing multi-threading, etc.). With reference to FIG. 1, the processor 801 can be positioned in at least one of the surface system 129 and the flow characterization tool 124. With reference to FIG. 2, the processor 801 can be positioned in at least one of the flow characterization tool 224 and the surface system 255. The computer device 800 includes a memory 807. The memory 807 can be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer device 800 also includes a bus 803 (e.g., PCI, ISA, PCI-Express, HyperTransport® bus, InfiniBand® bus, NuBus, etc.) and a network interface 805 (e.g., a Fiber Channel interface, an Ethernet interface, an internet small computer system interface, SONET interface, wireless interface, etc.).

The computer device 800 includes a flow characterization tool controller 811. The flow characterization tool controller 811 provides instructions to perform one or more operations described above. For example, the flow characterization tool controller 811 can provide instructions to stop or slow a flow characterization tool. Additionally, the flow characterization tool controller 811 can characterize flow based on the measurements from one or more mechanically sensitive sensors of the flow characterization tool.

Any one of the previously described functionalities can be partially (or entirely) implemented in hardware and/or on the processor 801. For example, the functionality can be implemented with an application specific integrated circuit, in logic implemented in the processor 801, in a co-processor on a peripheral device or card, etc. Further, realizations can include fewer or additional components not illustrated in FIG. 8 (e.g., video cards, audio cards, additional network interfaces, peripheral devices, etc.). The processor 801 and the network interface 805 are coupled to the bus 803. Although illustrated as being coupled to the bus 803, the memory 807 can be coupled to the processor 801. The computer device 800 can be a device at the surface and/or integrated into component(s) in the borehole. For example, with reference to FIG. 1, the computer device 800 can be incorporated in the flow characterization tool 80 and/or a computer at the surface.

As will be appreciated, aspects of the disclosure can be embodied as a system, method or program code/instructions stored in one or more machine-readable media. Accordingly, aspects can take the form of hardware, software (including firmware, resident software, micro-code, etc.), or a combination of software and hardware aspects that can all generally be referred to herein as a "circuit" or "system." The functionality presented as individual units in the example illustrations can be organized differently in accordance with any one of platform (operating system and/or hardware), application ecosystem, interfaces, programmer preferences, programming language, administrator preferences, etc.

Any combination of one or more machine readable medium(s) can be utilized. The machine-readable medium can be a machine-readable signal medium or a machine-readable storage medium. A machine-readable storage medium can be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium can be any tangible medium that can contain, or store a program for use by or in connection with an instruction execution system, apparatus, or device. A machine-readable storage medium is not a machine-readable signal medium.

A machine-readable signal medium can include a propagated data signal with machine readable program code embodied therein, for example, in baseband or as part of a carrier wave. Such a propagated signal can take any of a variety of forms, including, but not limited to, electromagnetic, optical, or any suitable combination thereof. A machine-readable signal medium can be any machine readable medium that is not a machine-readable storage medium and that can communicate, propagate, or transport a program for use by or in connection with an instruction execution system, apparatus, or device.

Program code embodied on a machine-readable medium can be transmitted using any appropriate medium, including but not limited to wireless, wireline, optical fiber cable, RF, etc., or any suitable combination of the foregoing.

Computer program code for carrying out operations for aspects of the disclosure can be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code can execute entirely on a stand-alone machine, can execute in a distributed manner across multiple machines, and can execute on one machine while providing results and or accepting input on another machine.

Variations

The program code/instructions can also be stored in a machine-readable medium that can direct a machine to function in a particular manner, such that the instructions stored in the machine-readable medium produce an article of manufacture including instructions which implement the function/act specified in the flowchart and/or block diagram block or blocks.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

While some of the above embodiments show the extendable members as being free to extend, some embodiments can have one or more extendable members locked into a position/orientation at one or both ends of the tool. While the above embodiments are shown with an elastic element (e.g. a spring), the elastic element is not necessary. For example, alternative embodiments can include extendable members that can freely extend and/or move longitudinally along the tool body, but do not require a spring or other elastic element to push against.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example Embodiments

Example embodiments include the following:

Embodiment 1: An apparatus comprising: a central body having a longitudinal axis; a first extended member attached to the central body, wherein the first extended member extends away from the longitudinal axis; and a first mechanically sensitive sensor mechanically coupled to the first extended member.

Embodiment 2: The apparatus of Embodiment 1: a second extended member attached to the central body, wherein the second extended member extends away from the longitudinal axis, and wherein the second extended member is at different axial position on the central body from the first extended member; and a second mechanically sensitive sensor mechanically coupled to the second extended member.

Embodiment 3: The apparatus of Embodiments 1 or 2, wherein the first mechanically sensitive sensor is a multidimensional sensor.

Embodiment 4: The apparatus of any of Embodiments 1-3, wherein the first extended member comprises an elastic material.

Embodiment 5: The apparatus of any of Embodiments 1-4, wherein the first extended member comprises two or more rigid arms.

Embodiment 6: The apparatus of any of Embodiments 1-5, wherein a friction-reducing element is attached to a distal end of the first extended member.

Embodiment 7: The apparatus of any of Embodiments 1-6: a first centralizer fixed to and co-axial with the central body; a second centralizer that is co-axial with the central body and longitudinally movable with respect to the central body, wherein the second centralizer is attached to the first extended member; and an elastic element having an elasticity along the longitudinal axis, wherein the elastic element is attached to the first centralizer and the second centralizer.

Embodiment 8: The apparatus of any of Embodiments 1-7, wherein the central body comprises an acoustic array tool, wherein the acoustic array tool comprises a set of radially distributed apertures.

Embodiment 9: The apparatus of any of Embodiments 1-8, further comprising a fourth mechanically sensitive sensor fixed to the central body.

Embodiment 10: A method comprising: lowering a flow characterization tool into a barrier, the flow characterization tool comprising, a central body having a longitudinal axis, a first extended member attached to the central body, wherein the first extended member extends away from the longitudinal axis, and a first mechanically sensitive sensor attached to the first extended member; and acquiring a first set of measurements of one or more mechanical waves using the first mechanically sensitive sensor, wherein the one or more mechanical waves are transferred to the first extended member.

Embodiment 11: The method of Embodiment 10, wherein the flow characterization tool further comprises a second extended member attached to the central body, wherein a second mechanically sensitive sensor is mechanically coupled to the second extended member, and wherein the method further comprises: acquiring a second set of measurements of the one or more mechanical waves using the second mechanically sensitive sensor, wherein the one or more mechanical waves are transferred to the second extended member; and characterizing a flow based on the second set of measurements.

Embodiment 12: The method of Embodiments 10 or 11, further comprising acquiring a second set of measurements, wherein the second set of measurements is orthogonal to the first set of measurements.

Embodiment 13: The method of any of Embodiments 10-12, further comprising: determining whether a motion-generated noise satisfies one or more noise criteria; and slowing or stopping the lowering of the central body in response to determining that the motion-generated noise does not satisfy the one or more noise criteria.

Embodiment 14: The method of any of Embodiments 10-13, further comprising: acquiring a control measurement while lowering the central body, wherein the control measurement is acquired while solid particle flow is not in contact with the barrier; and characterizing a flow based on the control measurement.

Embodiment 15: The method of any of Embodiments 10-14, further comprising: determining a measurement range having a lower bound frequency, wherein the lower bound frequency is greater than an average frequency of motion-induced noise generated by a motion of the flow characterization tool relative to the barrier; generating a comparison value by comparing the first set of measurements in the measurement range to a second set of measurements; and characterizing a flow based on the comparison value.

Embodiment 16: A system comprising: a flow characterization tool comprising, a central body having a longitudinal axis, a first extended member attached to the central body, wherein the first extended member extends away from the longitudinal axis, and a first mechanically sensitive sensor attached to the first extended member; a processor; and a machine-readable medium having program code executable by the processor to cause the system to, lower the flow characterization tool into a barrier, acquire a first set of measurements of one or more mechanical waves using the first mechanically sensitive sensor, wherein the one or more mechanical waves are transferred to the first extended member from the barrier, and characterize a flow based on the first set of measurements.

Embodiment 17: The system of Embodiment 16, wherein the flow characterization tool further comprises: a second extended member attached to the central body, wherein the second extended member extends away from the longitudinal axis, and wherein the second extended member is at a different axial position on the central body from the first extended member; and a second mechanically sensitive sensor mechanically coupled to the second extended member.

Embodiment 18: The system of Embodiments 16 or 17, wherein the first mechanically sensitive sensor is a multidimensional sensor, and wherein the first mechanically sensitive sensor can acquire a second set of measurements in an orthogonal direction relative to the first set of measurements.

Embodiment 19: The system of any of Embodiments 16-18, wherein the program code to characterize the flow further comprises program code to characterize the flow based on the second set of measurements.

Embodiment 20: The system of any of Embodiments 16-19, wherein the program code further comprises program code to: determine whether a motion-generated noise satisfies one or more noise criteria; and slow or stop the lowering of the flow characterization tool in response to a determination that the motion-generated noise does not satisfy the one or more noise criteria.

What is claimed is:

1. An apparatus comprising:

a flow characterization tool configured to move into position within an inside area of a barrier, the barrier extending inside a borehole formed in a subsurface formation, the barrier separating the inside area of the barrier from an annulus extending between an outer surface of the barrier and a borehole wall of the borehole, the flow characterization tool comprising:

a central body having a longitudinal axis;

a first extended member attached to the central body, wherein the first extended member extends away from the longitudinal axis to be mechanically coupled to an inner surface of the barrier when the flow characterization tool is moved into a position within the inside area of the barrier; and a first sensor attached to the first extended member and configured to generate first sensor measurements including measures of one or more vibrations in the barrier transferred to the first sensor through the first extended member, the one or more vibrations generated by one or more impacts with an outer surface of the barrier by a solid particle or by a flow of fluid within the annulus; and a processor coupled to the first sensor;

a machine-readable medium including instructions executable by the processor, the instructions including instructions to receive the first sensor measurements from the first sensor and to characterize a flow outside the barrier and within the annulus based at least in part on the first sensor measurements, determine that a motion generated noise satisfies one or more noise criteria, and slow or stop movement of the flow characterization tool into the position in response to the determination that the motion generated noise does not satisfy the one or more noise criteria.

2. The apparatus of claim 1, wherein the flow characterization tool further comprises:

a second extended member attached to the central body, wherein the second extended member extends away from the longitudinal axis, and wherein the second extended member is at a different axial position on the central body from the first extended member; and a second sensor attached to the second extended member, wherein the second sensor is configured to generate second sensor measurements including measures of one or more vibrations in the barrier transferred to the second sensor through the second extended member, the one or more vibrations generated by one or more impacts with the outer surface of the barrier by the solid particle or by the flow of fluid within the annulus, and wherein the processor is configured to receive the second sensor measurements from the second sensor and the instructions further include instructions to characterize the flow outside the barrier and within the annulus based at least in part on the second sensor measurements.

3. The apparatus of claim 1, wherein the first sensor is a multi-dimensional sensor.

4. The apparatus of claim 1, wherein the first extended member comprises at least one of mechanically elastic material and two or more rigid arms.

5. The apparatus of claim 1, wherein a friction-reducing element is attached to a distal end of the first extended member.

6. The apparatus of claim 1, further comprising an elastic element having an elasticity along the longitudinal axis, wherein the elastic element is attached to the central body and coupled with the first extended member.

7. The apparatus of claim 1 further comprising a third sensor attached to the central body and coupled to the processor, the third sensor configured to measure a reference measurement used by the processor to decouple particle impacts from one or more other acoustic effects present in the borehole.

8. The apparatus of claim 1, wherein the barrier comprises at least one of a casing, a tubing, and a sand screen.

9. A method comprising:

positioning a flow characterization tool within an inside area of a barrier, the barrier extending inside a borehole formed in a subsurface formation, the barrier separating the inside area of the barrier from an annulus extending between an outer surface of the barrier and a borehole wall of the borehole;

acquiring a first set of vibration measurements using a first of a plurality of sensors attached to extended members that are coupled with the flow characterization tool, the first set of vibration measurements including a measurement of any vibrations in the barrier transferred to the first of the plurality of sensors and generated by one or more impacts on an outer surface of the barrier caused by a solid particle or a flow of fluid present within the annulus; and characterizing a flow outside of the barrier and within the annulus based, at least in part, on the first set of vibration measurements;

determining that a motion-generated noise satisfies one or more noise criteria; and slowing or stopping the positioning of the flow characterization tool in response to the determination that the motion-generated noise does not satisfy the one or more noise criteria.

10. The method of claim 9, further comprising acquiring a second set of vibration measurements, wherein the second set of vibration measurements is obtained from a second of the plurality of sensors that is attached to the extended members.

11. The method of claim 10, wherein the second set of vibration measurements is orthogonal to the first set of vibration measurements.

12. The method of claim 9, wherein characterizing the flow outside the barrier includes comparing the first set of vibration measurements with one or more control measurements, wherein the control measurements comprise one of mechanical measurements acquired before introduction of solid particle flow, mechanical measurements acquired after introduction of solid particle flow, stored mechanical measurements of a damaged well, and stored mechanical measurements of an undamaged well.

13. The method of claim 9, further comprising:

determining a lower bound frequency of an impact detection range, wherein the lower bound frequency is greater than an average frequency of motion-induced noise generated by a motion of the flow characterization tool relative to the barrier, and wherein an upper bound of the impact detection range is based, at least in part, on one or more measurement ranges of the first of the plurality of sensors; wherein characterizing the flow outside of the barrier comprises comparing those of the first set of vibration measurements in the impact detection range with one or more control measurements.

14. The method of claim 9, wherein the barrier comprises at least one of a casing, a tubing, and a sand screen.

15. The method of claim 9, further comprising:

determining that a motion-generated noise does not satisfy one or more noise criteria; and slowing or stopping the positioning of the flow characterization tool at a first target position that corresponds to an increase in measurement quality relative to a position of the flow characterization tool based on the determination that the one or more noise criteria are not satisfied.

16. A system comprising:

a flow characterization tool configured to be positioned within an inside area of a barrier, the barrier extending inside a borehole formed in a subsurface formation, the barrier separating the inside area of the barrier from an annulus extending between an outer surface of the barrier and a borehole wall of the borehole, the flow characterization tool comprising:

a central body having a longitudinal axis;

a first extended member attached to the central body, wherein the first extended member extends away from the longitudinal axis and is configured to be mechanically coupled to an inner surface of the barrier when the flow characterization tool moves into a position within the inside area of the barrier;

a first sensor attached to the first extended member and configured to detect one or more vibrations in the barrier transferred to the first sensor through the first extended member, the one or more vibrations generated by one or more impacts on an outer surface of the barrier caused by a solid particle or a flow of fluid within the annulus;

a processor coupled to the first sensor;

a machine-readable medium including instructions executable by the processor, the instructions including instructions to characterize a flow outside the barrier in the annulus based, at least in part, on the one or more vibrations detected by the first sensor, determine that a motion generated noise satisfies one or more noise criteria, and slow or stop movement of the flow characterization tool into the position in response to the determination that the motion generated noise does not satisfy the one or more noise criteria; and a conveyance or a drill string configured to couple to the flow characterization tool and configured to control the positioning of the flow characterization tool within inner areas of the barrier.

17. The system of claim 16, wherein the system further comprises:

a second extended member attached to the central body, wherein the second extended member extends away from the longitudinal axis, and wherein the second extended member is at a different longitudinal position on the central body relative to the first extended member; and a second sensor attached to the second extended member, wherein the second sensor is configured to generate second sensor measurements including measures of one or more vibrations in the barrier transferred to the second sensor through the second extended member, the one or more vibrations generated by one or more impacts with the outer surface of the barrier by the solid particle or by the flow of fluid within the annulus, and wherein the processor is configured to receive the second sensor measurements from the second sensor and the instructions further include instructions to characterize the flow outside the barrier and within the annulus based at least in part on the second sensor measurements.

18. The system of claim 17, wherein the system further comprises:

a third extended member attached to the central body, wherein the third extended member extends away from the longitudinal axis, and wherein the third extended member is located at a different position along the longitudinal axis of the central body as the second extended member; and a third mechanically sensitive sensor attached to the third extended member.

19. The system of claim 16, wherein the first sensor is a multi-dimensional sensor, and wherein the first sensor can acquire a second set of measurements in an orthogonal direction relative to the second sensor measurements.

20. The system of claim 19, wherein the instructions further include instructions to characterize flow based, at least in part, on comparison of the second set of measurements and one or more control measurements.

21. The system of claim 16, wherein the instructions further include instructions to:

determine whether a motion-generated noise satisfies one or more noise criteria; and control the conveyance or drill string to slow or stop lowering of the flow characterization tool in response to a determination that the motion-generated noise does not satisfy the one or more noise criteria.

22. The system of claim 16, wherein the barrier comprises at least one of a casing, a tubing, and a sand screen.

23. The system of claim 16, wherein the central body is the central body of an acoustic array tool.

* * * * *